US005224695A

United States Patent [19]

Svyatsky et al.

[11] Patent Number: 5,224,695

[45] Date of Patent: Jul. 6, 1993

[54] METHOD AND APPARATUS FOR FEEDING DOCUMENTS

[75] Inventors: Eduard Svyatsky; Jerry Loftis, both of Libertyville; George I. Paroubek, Downers Grove; Frederick P. Hegland, Des Plaines; Wesley Dobrzanski, Chicago; Thomas J. Faber, Skokie, all of Ill.

[73] Assignee: Bell & Howell Company, Skokie, Ill.

[21] Appl. No.: 871,498

[22] Filed: Apr. 21, 1992

[51] Int. Cl.[5] ..... B65H 7/08; B65H 3/06

[52] U.S. Cl. ..... 271/110; 271/117; 271/126; 271/153; 271/155; 271/114

[58] Field of Search ..... 271/110, 38, 152, 153, 271/154, 155, 114, 126, 117

[56] References Cited

U.S. PATENT DOCUMENTS

| | | | |
|---|---|---|---|
| 3,754,754 | 8/1973 | Peterson . | |
| 3,966,193 | 6/1976 | Storace et al. | 271/110 |
| 3,981,493 | 9/1976 | Klappenecker et al. | 271/114 |
| 3,981,497 | 9/1976 | Feinstein et al. | 271/110 |
| 4,061,329 | 12/1977 | Sachuk et al. . | |
| 4,203,586 | 5/1980 | Hoyer . | |
| 4,368,881 | 1/1983 | Landa . | |
| 4,420,151 | 12/1983 | Kobayashi . | |
| 4,522,385 | 6/1985 | Stefanson . | |
| 4,674,736 | 6/1987 | Tsubo . | |
| 4,709,911 | 12/1987 | Saiki et al. . | |
| 4,753,433 | 6/1988 | Rodi et al. . | |
| 4,822,023 | 4/1989 | Miyoshi . | |
| 4,884,797 | 12/1989 | Svyatsky | 271/126 |
| 4,891,088 | 2/1990 | Svyatsky . | |
| 5,104,109 | 4/1992 | Kubo | 271/110 |
| 5,129,642 | 7/1992 | Svyatsky et al. . | |

FOREIGN PATENT DOCUMENTS

| | | | |
|---|---|---|---|
| 0364790 | 4/1990 | European Pat. Off. | 271/152 |
| 3706810 | 3/1988 | Fed. Rep. of Germany | 271/126 |
| 56-61242 | 5/1981 | Japan . | |
| 829719 | 3/1960 | United Kingdom . | |

*Primary Examiner*—H. Grant Skaggs

[57] ABSTRACT

Document feeding apparatus advances the leading document in a stack of documents against a moveable feed element which moves at a predetermined, load sensitive speed. The torque applied to the leading document by the feed element is maintained at a substantially constant level by sensing the speed of the moveable feed element and electronically controlling the pressure applied by the stack of documents against the moveable feed element in order to maintain the torque applied by the moveable feed element to the leading document of the stack at a substantially constant value.

22 Claims, 4 Drawing Sheets

METHOD AND APPARATUS FOR FEEDING DOCUMENTS

This invention relates to methods and apparatus for feeding documents, and more particularly, to apparatus which controls and applies a torque to individual documents in a stack by a feed mechanism which removes single documents from the stack of documents, whereby the torque applied to each document is responsive to the normal force applied to the document and is sufficient to remove the document from the stack with the application of minimum torque.

BACKGROUND OF THE INVENTION

Document feeding equipment is used by post offices and businesses to process mail or other documents at high speeds and in high volumes. In postal applications, a stack of upright envelopes is placed in a feed tray, and the stack is advanced against one or more moveable roller or feeder elements which engage the leading envelope, rapidly remove it from the stack, and transfer it to a processing station. However, the pressure placed on the rollers or feeder elements, and the resulting torque applied to the lead document, is not controlled and is not constant. As a result, more than one document is sometimes removed from the stack at a time, requiring additional apparatus to separate the multiple documents. Further singulation is inefficient, however, and increases the complexity and efficiency of the equipment. Thus, there is a need for document feeding equipment which does not remove more than one document from a stack at a time, and which controls the normal force applied by a magazine to a stack of documents whereby the lead document is removed from the stack upon the application of minimum torque.

Accordingly, one object of this invention is to provide new and improved methods and apparatus for feeding documents.

Another object is to provide new and improved methods and apparatus for individually removing documents from a stack of documents, without removing multiple documents.

Still another object is to provide new and improved methods and apparatus for removing documents from a stack of documents by controlling the normal force applied by a moveable feed element to a stack of documents, whereby a minimum torque is applied to the lead document in the stack to remove the lead document from the stack.

SUMMARY OF THE INVENTION

In keeping with one aspect of this invention, a document feeding apparatus includes means for advancing the leading document in a stack of documents against at least one, and preferably two, infeed roller wheels which rotate at a predetermined speed with limited torque, so that the speed of the infeed roller wheels is responsive to, and a function of, changes in the load placed on the wheels by the normal pressure in the stack of documents. The pressure placed against the roller wheels by the stack of documents as the stack is mechanically advanced toward the wheels is controlled by sensing changes in the speed of the infeed roller wheels, and electronically controlling the stack advancing mechanism to maintain a limited torque range applied by the feed roller wheels to the leading document, such that the torque is sufficient to remove only the leading document from the stack. When the leading document is removed by the infeed roller wheels, the next document in the stack becomes the leading document, and is processed in the same manner as the first document.

The stack of documents is advanced against the infeed roller wheels by one or more magazine conveyor belts which are controlled by a motor. The stack of documents is disposed on top of or adjacent the conveyor belts. The speed of movement, or rotation, of the infeed wheels is determined by the rate at which the documents are to be processed. The torque applied by the infeed roller wheels against the lead document is determined by the frictional and inertial resistance of the document, and is sufficient to remove the document from the stack upon the application of a minimum torque. The speed of the infeed wheels is responsive to changes in the pressure applied against the infeed wheels by the stack.

A limited torque clutch provides a normal range of operative speed of the infeed rollers, and a limit to that range whereby the speed of the infeed rollers drops rapidly upon the application of additional pressure by the stack of documents upon the infeed rollers. An electric generator rotatably connected to one of the infeed roller wheels develops a reference voltage which is related to the rotational speed of the infeed roller wheels. If the infeed roller wheel speed increases, sensing an absence of documents against the infeed roller, a control circuit increases the forward speed of the magazine conveyor belts, which advances documents towards the wheels and increases the stack pressure on the leading document upon the infeed wheels. This pressure slows down the infeed wheels to a predetermined desired speed. If the infeed roller wheel speed decreases, sensing excess document pressure against the rollers, the speed of the magazine conveyor belts decreases, or reverses, thereby moving the documentation in a direction away from the infeed rollers and decreasing the pressure applied by the stack of documents against the infeed wheels such that the speed of the infeed wheels increases towards the predetermined desired speed. In this manner, the pressure placed against the infeed roller wheels by the stack of documents, as well as the speed of the roller wheels, are maintained substantially constant, which results in a constant magazine pressure being applied by the infeed rollers to the leading document in the stack.

In an alternate embodiment, a moveable belt document drive system is used in place of the feed roller wheels described above.

BRIEF DESCRIPTION OF THE DRAWINGS

The above mentioned and other features of an embodiment of this invention and the manner of obtaining them will become more apparent, and will be best understood by reference to the following description, taken in conjunction with the accompanying drawings, in which.

DETAILED DESCRIPTION

Figure 1:
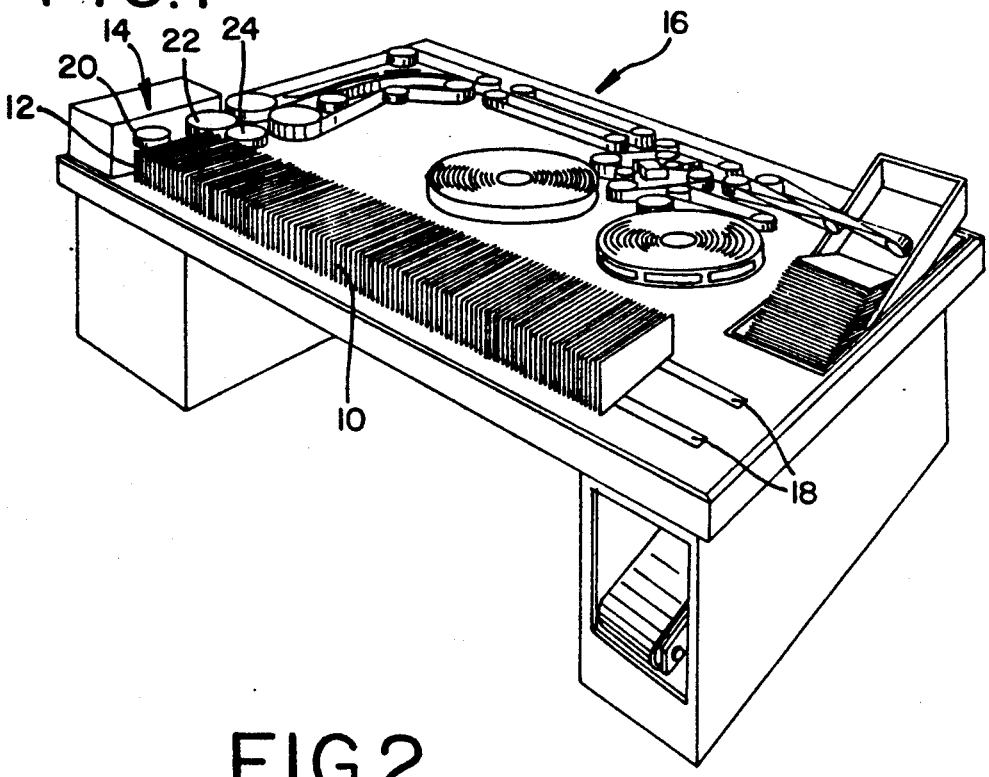
FIG. 1 is a perspective view of a document feeding apparatus made in accordance with the principles of the present invention.

As seen in FIG. 1, a stack of documents, depicted here as envelopes 10, including a leading envelope 12, is placed in document feeding apparatus 14. The apparatus 14 may be part of a larger machine 16, such as a machine for applying labels to the envelopes 10 at high speed.

Figure 4:
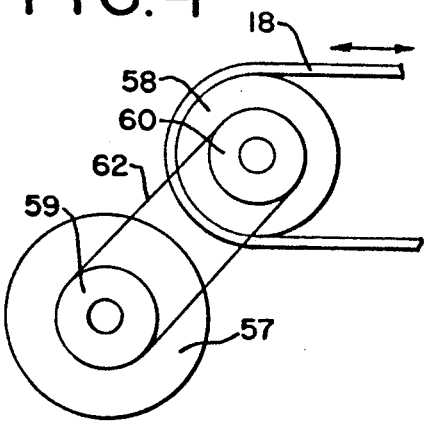
FIG. 4 is a partial detail view of the conveyor belt drive system of the present invention.

The document feeding apparatus 14 includes a pair of conveyor belts 18 upon which the stack of envelopes 10 is supported, and a moveable, rotating infeed roller assembly or element 20. The conveyor belts 18 are driven by a forward-reverse drive motor 57 (FIG. 4) which can advance the stack of envelopes against the infeed roller assembly 20 or drive the stack away from the infeed roller assembly 20. When the leading envelope 12 is pressed against the infeed roller assembly 20, it is removed from the stack and fed between two rotating accelerator roller assemblies 22, 24. The roller assemblies 22, 24 rotate at a faster rate than the roller assembly 20, so that the leading envelope 12 is rapidly separated from the ensuing envelope in the stack 10, which then becomes the leading envelope.

Figure 2:
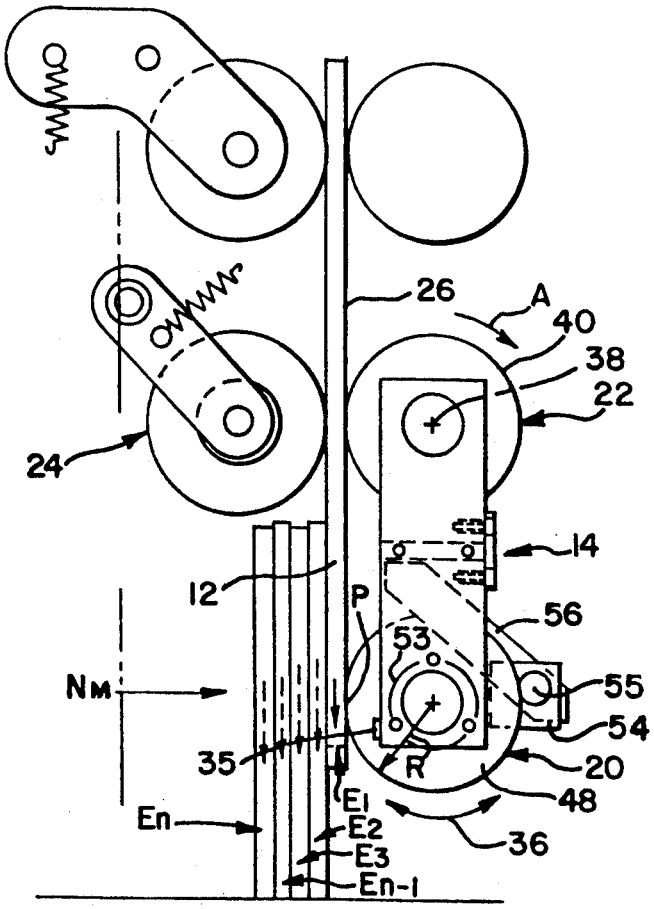
FIG. 2 is a plan schematic view of a portion of the apparatus of FIG. 1.

The manner in which a succession of envelopes 10 are fed from a stack between the roller assemblies 22, 24 is illustrated in FIG. 2. The leading envelope 12, also designated $E_1$ in FIG. 2, is fed between the roller assemblies 22, 24 by the rotation of infeed roller assembly 20. The roller assembly 20 engages the envelope $E_1$ due to the friction force between the rotating roller assembly 20 and a surface 26 of the leading envelope $E_1$. The friction force is created because the conveyor belts 18 press the leading envelope $E_1$ against the roller assembly 20, creating a normal force $N_M$ in the stack of documents against the roller assembly 20. The roller assembly 20 applies a torque to the lead envelope at point P which propels the leading envelope $E_1$ out of the stack. The torque at point P equals the product of the normal force $N_M$ and the radius R of roller assembly 20. This torque is sufficient to overcome the lesser friction force tending to hold envelope $E_1$ against envelope $E_2$.

When the envelope $E_1$ is fed between the accelerator assembly 22, 24, the envelope $E_2$ becomes the leading envelope, and the envelope $E_2$ is pressed against the feed wheel assembly 20. This process continues until all of the envelopes $E_3$, $E_{n-1}$ and $E_n$ are fed between the accelerator roller wheel assemblies 22, 24.

Figure 3:
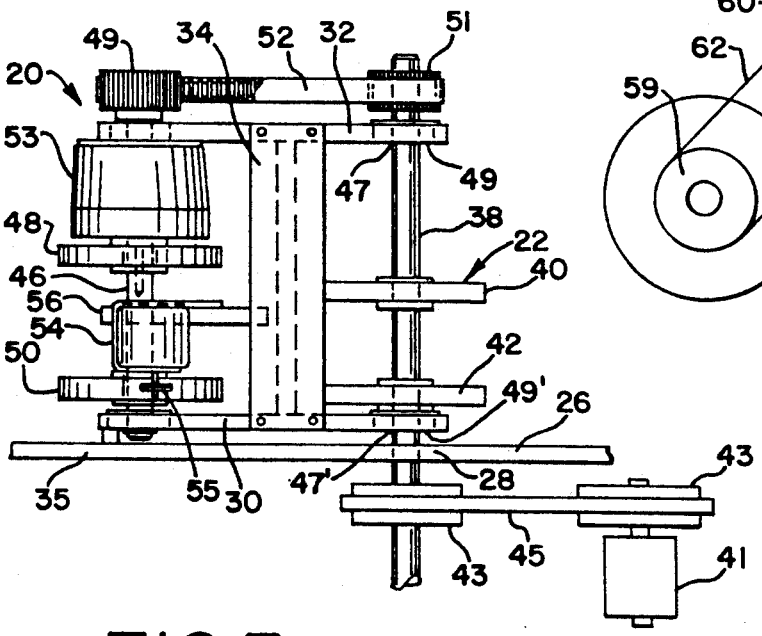
FIG. 3 is an elevational view of the apparatus shown in FIG. 2.

The roller assemblies 20, 22, 24 are illustrated in greater detail with reference to both FIGS. 2 and 3. Accelerator roller assembly 22 includes a pair of wheels or rollers 40, 42 commonly mounted in spaced relation for rotation on a shaft 38. Shaft 38 is rotatably mounted at one end to a stationary base plate 26 by means of a suitable bearing 28. The rollers 40, 42 are secured to the shaft 38 for rotation in the direction indicated by the arrow A in FIG. 2. The shaft 38 is rotated in the bearing 28 by a motor 41 through a pair of pulleys 43 and a belt 45.

The infeed roller assembly 20 is secured to the assembly 22 by a cantilevered support system comprising a bottom arm 30, a top arm 32, and a vertical support 34 extending between and attached to arms 30 and 32. As shown in FIG. 3, the right side of top arm 32 includes a bearing 47 disposed in an aperture 49 through which shaft 38 rotatably extends. Likewise, the right side of bottom arm 30 includes a bearing 47' disposed in an aperture 49' through which shaft 38 rotatably extends. Vertical support 34 maintains arms 30 and 32 rigidly spaced apart, and provides the cantilevered support for infeed roller assembly 20. The assembly 20 pivots back and forth around shaft 38 in the direction of arrow 36 shown in FIG. 2. A stop 35 limits movement of the assembly 20 in the direction away from the envelopes. The stop 35 counteracts the minimal movement of the assembly 29 caused by the rotation of shaft 38 through bearings 49 and 49'.

The assembly 20 includes a shaft 46 and rollers 48, 50 secured to the shaft 46 for rotation with the shaft. The shaft 46 is rotated by the shaft 38 through pulleys 49, 51, a timing belt 52 and a limited torque clutch 53. The clutch 53 is a commercially available device which can be electrically set to turn the shaft 46 and roller wheels 48, 50 with a selected, and preferably adjustable torque. As the torque applied to the circumference of infeed roller 20 increases to a predetermined maximum range of values, resulting from increased pressure from the stack of documents applied to the infeed roller, the speed of rotation of roller 20 is reduced dramatically. As will be explained, this reduction in speed, resulting from excessive torque required to drive the lead envelope from the stack, is sensed to control the movement of magazine belts 18. The torque range of the rollers 48, 50 applied to the lead document in the stack of documents 10 is preferably relatively low, such as from 2.8 to 3.8 inch-ounces in a preferred embodiment, and is lower than the torque generated by the motor 41.

The torque applied by the wheels 48, 50 is predetermined so that all of the envelopes $E_1$, $E_2$ etc., are slightly separated from each other, which is about 2.8 to 3.8 inch-ounces if the coefficient of friction between the envelopes and the wheels is about 0.5. At such relatively low torque, the speed of the wheels 48, 50 is sensitive to changes in the load placed on the wheels by the advancing envelopes. That is, the wheels 48, 50 slow down considerably in response to relatively small changes in the pressure placed on the wheels 48, 50 by the conveyor belts 18 acting to advance the envelopes.

An electric generator 54 having a rotating wheel 55 is secured to the infeed wheel assembly 20 by an arm 56. The wheel 55 is rotated through contact with infeed roller wheel 50, which forms part of infeed roller assembly 20. The voltage output of the generator 54 is determined by the speed of rotation of the wheel 55, which in turn is related to the speed of the wheel 50. In this manner, the generator 54 senses changes in the speed of the wheel 55 by generating a voltage output which is responsive to the speed of the wheel 50.

The conveyor belts 18 which support and advance or retreat the stack of documents 10 are controlled by a motor 57 (FIG. 4) through a roller 58, drive pulleys 59, 60 and a belt 62. The motor 57 is reversible, so that the conveyor belts 18 can move the stack of envelopes towards or away from the infeed wheel assembly 20, depending upon whether more or less pressure is needed to maintain the application of a substantially constant, minimum torque to each sequential lead envelope $E_1$ by rollers 48 and 50.

Figure 5:
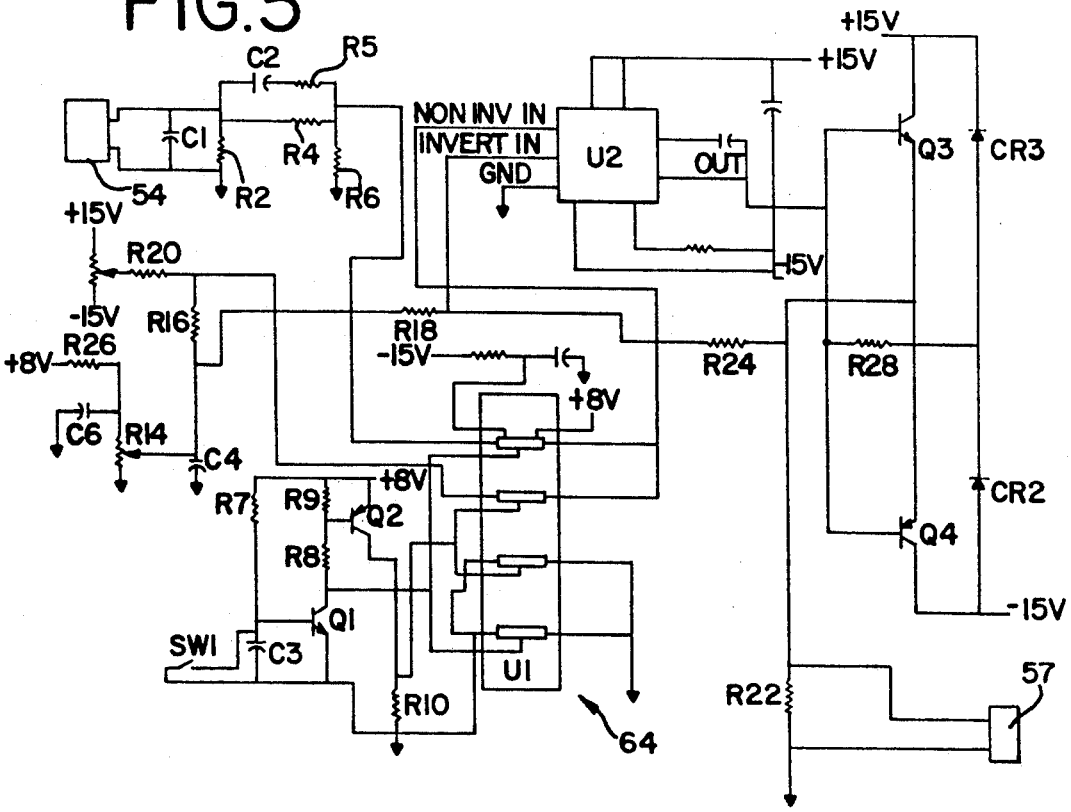
FIG. 5 is a schematic of a control circuit used to operate the apparatus of FIG. 1.

The operation of motor 57 is controlled by a control circuit 64, shown in FIG. 5. The voltages shown are supplied by any suitable power source. Nominal values of components are given here, but other values could be used.

The output voltage of the generator 54 (about 4–5 volts) is processed through a capacitor $C_1$ (100 uF), and a network which includes capacitor C2 (10 uF) and resistors R2 (2.7K), R4 (10K), R5 (1K) and R6 (2.2K). The voltage over R6 is input to an analog switch U1, which can be a quad bilateral analog switch such as an RCA CD4066B integrated circuit. The four analog switches in U1 are enabled and disabled by a switch SW1, which controls transistors Q1 (2N4401) and Q2 (2N4403) through resistors R7 (2.2K), R8 (2.2K), R9 (1K) and R10 (1K), and a capacitor C3 (0.1 nF). When the switch SW1 is closed, the first (upper-most) U1 is enabled, and a voltage related to the voltage over R6 is applied to the non-inverted input of a differential amplifier U2 (LH0021CK).

A reference voltage is set by adjusting variable amplifier resistor R12 (10K), after a resistor R14 (100 ohms) has been adjusted in a manner to be described. The voltage at the node of resistor R16 (1.8K) and capacitor C4 (1 uF) is applied to the inverted input of U2 through a resistor R18 (1.8K). The reference voltage is obtained through a resistor R20 (4.7M).

The output of U2 is applied to the bases of transistors Q3 (2N3055) and Q4 (M32955). Q3 and Q4 are of opposite polarities (Q3 being NPN device and Q4 being a PNP device), so that only Q3 conducts if the output of U2 is positive, and only Q4 conducts if the output of U2 is negative. If U2 does not produce an output, neither Q3 nor Q4 produce an output.

The emitters of Q3 and Q4 are connected to the motor 57. When Q3 conducts, the motor 57 turns in one direction, and when Q4 conducts, the motor 57 turns in the opposite direction. Thus, if the output voltage of the generator 54, as adjusted and applied to the non-inverted input of U2, is greater than the reference voltage, indicating that the wheel 55 is turning too fast, then U2 generates an output which turns on Q3, and the motor 57 operates conveyor belts in a first direction to move the stack of envelopes towards the roller wheel assembly 20 to increase the normal force applied by the stack of documents against infeed rollers 48, 50 to the lead envelope $E_1$. If the adjusted output voltage of the generator 54 is less than the reference voltage, indicating that the wheel 55 is turning too slowly due to excessive pressure upon the leading envelope $E_1$, then U2 produces an opposite polarity output, turning on Q4. The motor 57 then operates to drive conveyor belts 18 in the opposite direction, and the stack of envelopes is moved away from the infeed wheel assembly 20.

A load resistor R22 (50 ohm, 10 w) is provided in parallel with the motor 57. The voltage over the motor 57 is set to zero by adjusting the resistor R14 through a resistor R18 (516 ohm). The voltage over R14 is maintained substantially constant by a connection to an 8 volt power source through a resistor R26 (430 ohm), however, and the motor speed is substantially independent of the reference voltage.

A capacitor C6 (10mF) is connected in parallel with the resistor R14. A biasing resistor R28 (3 ohm) and diodes CR2 (1N4002) and CR3 (1N4002) are also provided for Q3 and Q4.

The rotation of shaft 38 in the direction of arrow A in FIG. 2 provides sufficient torque on feed roller assembly 20 through belt 52 to continually bias infeed roller wheels 48, 50 into contact with the stack of envelopes 10, and particularly, into contract with lead envelope 12. If the pressure of the stack of envelopes 10 becomes excessive, the entire roller assembly 20 rotates in the direction indicated by the right end of arrow 36 (FIG. 2) to enable the torque applied by rollers 48, 50 to lead envelope 12 to remain as close to the pre-determined torque level as possible. When pressure applied by the stack of envelopes against rollers 48, 50 has been relieved by the halting or reversal of movement of conveyor belts 18, infeed roller assembly 20 rotates towards the stack in the direction indicated by the left end of arrow 36 under the influence of rotating shaft 38, thus maintaining contact between the rollers 48, 50 and the stack of envelopes.

In an alternate embodiment, a spring force (not shown) could be used to bias roller assembly 20, and rollers 48, 50, into contact with the stack of envelopes.

Figure 6:
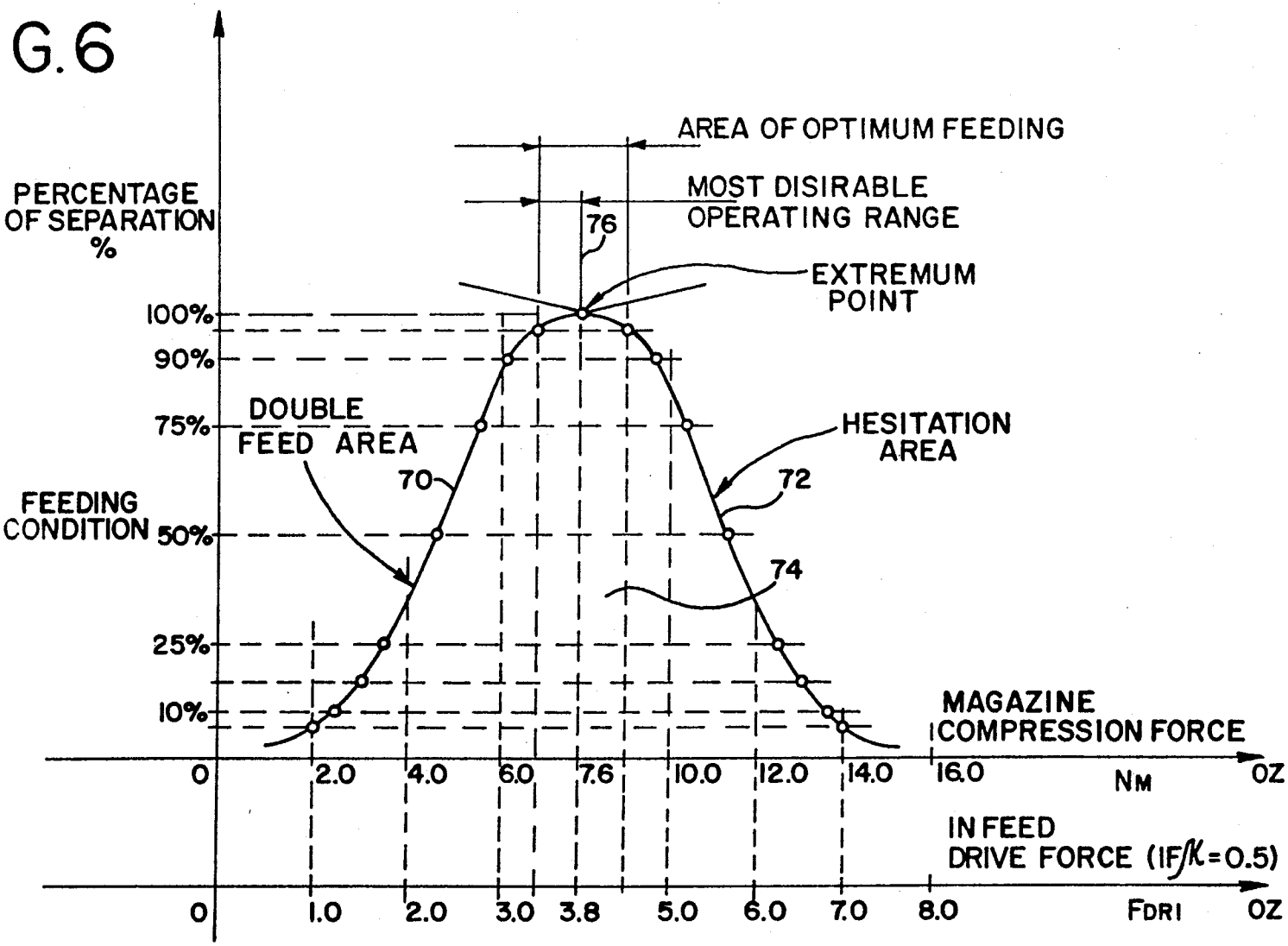
FIG. 6 is force diagram illustrating the determination of the optimum range of normal force applied by the documents in the magazine against the infeed rollers of the device illustrated in FIGS. 2 and 3.

FIG. 6 is a diagram showing how the optimum torque range between infeed roller 20 and documents 12 is derived. The chart plots an example of normal forces ($N_m$) on one absiccisa, and the drive force ($F_{DRI}$) applied by infeed roller 20 to each successive document 12 at point P (FIG. 2) as a second absiccisa. The ordinate of the chart represents the percentage of times a single document is fed from the system, rather than doubles or multiples feeds. The optimum feed condition is 100% single feeds. The curve 70 depicts the high amount of double or multiple feeds that can be expected when the stack normal force $N_M$, and the consequent document drive force $F_{DRI}$ is low. As these forces increase, the amount of multiple feeds decreases to a theoretical point approaching 100% single feeds. The curve 72 depicts the onset of multiple feeds as the normal force and document drive force goes above an optimum range, causing hesitation in feeding the documents due to excessive force.

Where curves 70 and 72 cross defines an area where minimum multiple feeding of documents occurs with minimum hesitation. The shaded area 74 represents a practical range over which optimum feeding can be achieved with minimum multiple feeds and minimum hesitation. The more desirable operating range of shaded area 74 is that found on the left of verticle line 76, where a slightly greater degree of hesitation is acceptable over the possibility of greater multiple feeds. In the example illustrated in FIG. 6, the normal force $N_M$ is preferably controlled within one ounce, and the consequent drive force $F_{DRI}$ controlled within 0.5 ounce. In other words, in the illustrated example, limited torque clutch 53 is pre-set to decrease the speed of infeed roller 20 when the normal force reaches approximately 6.0 to 7.6 ounces. The infeed roller speed decrease is sensed by sensor element 55, because in the unique device described herein, the speed of infeed roller 20 beyond a pre-set range is directly proportional to the normal pressure $N_M$ applied by the stack to the infeed roller. The analysis shown in FIG. 6 illustrates how the range of limited torque clutch 53 is established.

Figure 7:
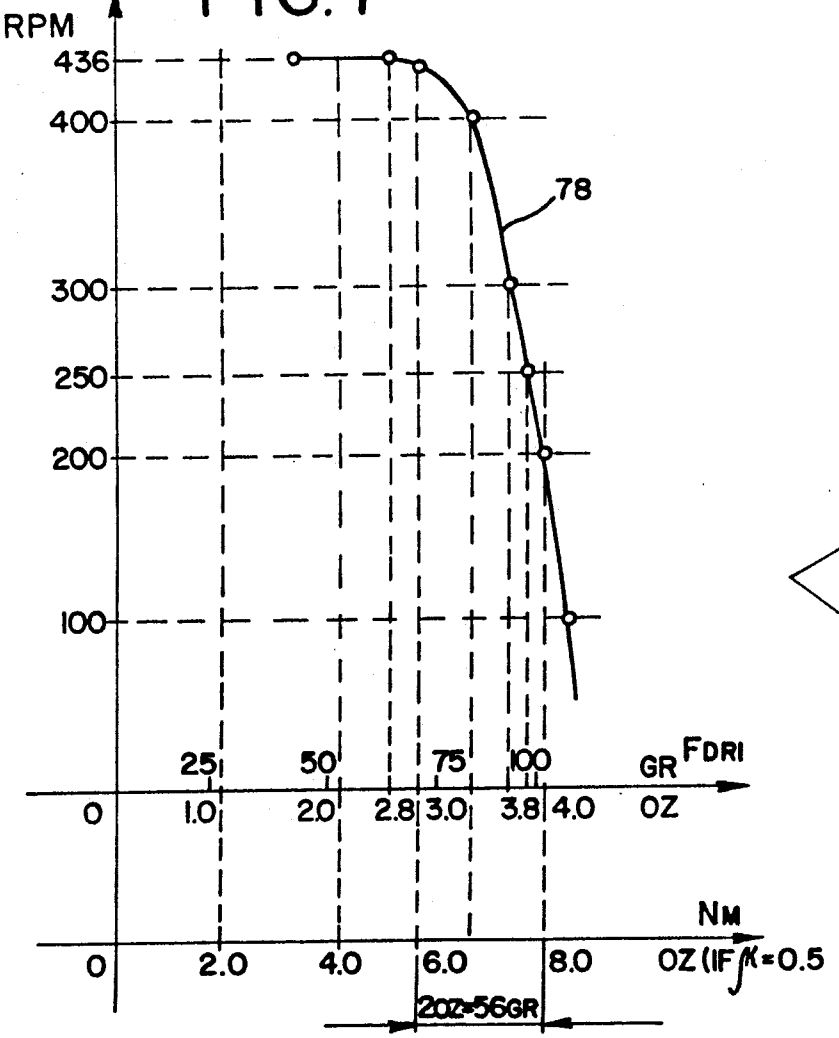
FIG. 7 is a diagram illustrating how the limited torque clutch employed in the drive train for the infeed rollers of the present invention affects the speed of rotation of the infeed rollers of the device illustrated in FIGS. 2 and 3 as the normal force applied by the stack of documents against the infeed rollers increases.

FIG. 7 is a diagram illustrating the relation between the rotative speed of infeed roller 20 and the document drive force $F_{DRI}$ and normal force $N_M$ as established by limited torque clutch 53. Curve 78 shows that once the pre-determined document force $F_{DRI}$ is reached, the speed of the infeed roller decreases dramatically. This speed decrease is sensed by sensor element 53, and magazine belts 18 are driven as previously described.

Figure 8:
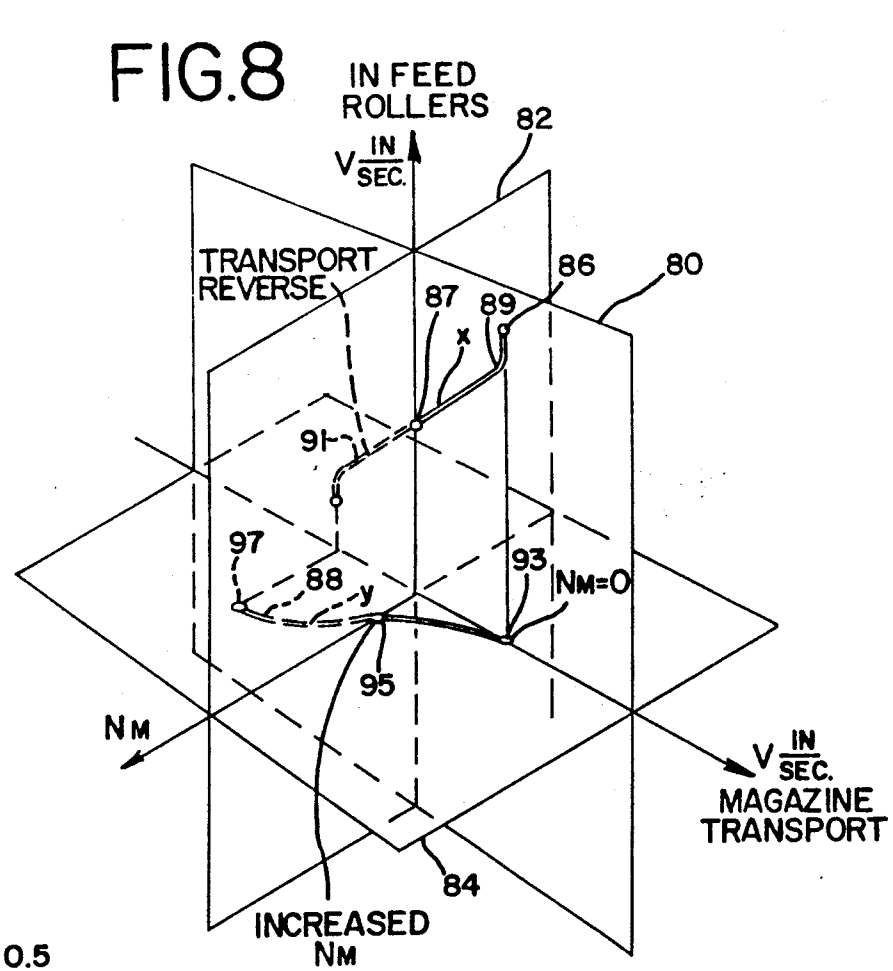
FIG. 8 in a tri-dimensional diagram show the relationship between speed of the infeed rollers, movement of the magazine transport system, and the normal force applied by the stack of documents on the infeed rollers of the device illustrated in FIGS. 2 and 3.

FIG. 8 is a three-dimensional graphic illustration showing the relationship between the velocity of the infeed rollers 20, the velocity and direction of movement of magazine belts 18, and the normal force $N_M$ applied by the stack against the infeed rollers 20. Plane 80 and curve 86 represents the direction and velocity of the magazine belts 18 as a function of the speed of the infeed rollers 20. The latter is also a function of the driving force $F_{DRI}$ applied by the stack of envelopes to infeed rollers 20. Note that curve 86 is wholly within plane 80 in the illustration of FIG. 8.

Point 87 is a value of infeed roller velocity which represents an optimum $F_{DRI}$ value. As the infeed roller speed increases, the velocity of the magazine belts 18 increases in a direction towards the infeed rollers 20. The higher speed of rollers 20 indicates that not enough envelopes are in the feed system, and the magazine belts 18 are actuated to advance more envelopes towards the infeed rollers. As more envelopes are advanced, $N_M$ increases, and the speed of infeed rollers decreases, as shown by the portion 89 of curve 86.

As more envelopes are advanced toward the infeed rollers by the magazine belts, optimum point 87 is reached. At this point, advancement of magazine belts 18 is stopped. When $N_M$ becomes excessive, infeed roller 20 slows down and a signal is sent to motor 57 to drive magazine belts 18 in a direction away from infeed rollers 20, and reduce $F_{DRI}$ such that the speed of infeed rollers 20 increases towards point 87.

Curve 88 in plane 84 illustrates how the stack normal force $N_M$ varies with the velocity of the magazine transport. At the condition designated by point 93, the stack normal force is zero, and the velocity of the infeed rollers is at its maximum. As the normal force $N_M$ increases along curve 88, it reaches an optimum value 95 where the speed of the magazine belts is zero. At this point, the normal force applied is sufficient to produce a document drive force $F_{DRI}$ in the optimum or preselected range. As the magazine transport belts 18 move in a direction away from the infeed belts, the stack normal force continues to increase to the point 97 as the pressure of the stack against the infeed rollers is decreased, and the speed of the infeed rollers increases.

The many advantages of this invention are now apparent. Documents are individually removed from a stack of documents, without removing multiple documents. The documents are fed more efficiently, without the need for additional equipment for separating multiple documents. In addition, document feeding is independent of the number of documents in the stack, even if the stack is tilted towards the infeed assembly 20.

While the principles of the invention have been described above in connection with specific apparatus and applications, it is to be understood that this description is made only by way of example and not as a limitation on the scope of the invention.

I claim:

1. An apparatus for sequentially and uniformly removing a lead document from a stack of documents comprising:

feeder means for removing the lead document from the stack of documents by applying a torque to a face of said lead document, said feeder means including document contact means moveable at varying speeds to remove said lead document from said stack of documents when in contact with said lead document, said speeds varying in response to the pressure applied against said feeder means by said stack of documents;

document advancing means supporting said documents and having a first mode of operation maintaining said lead document in contact with said feeder means, said document advancing means applying a predetermined pressure against said feeder means such that said feeder means applies a predetermined torque to said lead document to remove said document from said stack;

said document advancing means having additional modes of operation increasing or decreasing the pressure applied by said stack of documents against said feeder means;

said feeder means including sensor means generating a signal responsive to the speed of movement of said document contact means;

said signal applied to drive means for said document advancing means to control the movement of said stack of documents relative to said feeder means to maintain the torque applied by said feeder means to said lead document at substantially said predetermined torque.

2. The document removal apparatus of claim 1 wherein when said signal indicates that said torque applied by said feeder means to said lead document is less than said predetermined torque, said drive means operates to advance said stack of documents toward said feeder means.

3. The document removal apparatus of claim 1 wherein when said signal indicates that said torque applied by said feeder means to said lead document is substantially the same as said predetermined torque, said drive means becomes inactive and the movement of said stack of documents relative to said feeder means is halted.

4. The document removal apparatus of claim 1 wherein when said signal indicates that said torque applied by said feeder means to said lead document is greater than said predetermined torque, said drive means operates to move said stack of documents in a direction away from said feeder means.

5. The document removal apparatus of claim 1 wherein said speed of said document contact means is a predetermined speed when said feeder means applies said predetermined torque to said lead document.

6. The document removal apparatus of claim 5 wherein said document advancing means advances said stack of documents toward said feeder means when the speed of said document contact means is greater than said predetermined speed.

7. The document removal apparatus of claim 5 wherein said document advancing means halts the advancement of said stack of documents toward said feeder means when the speed of said document contact means is substantially the same as said predetermined speed.

8. The document removal apparatus of claim 5 wherein said document advancing means reverses the advancement of said stack of documents and moves said stack of documents away from said feeder means when the speed of said document contact means is less than said predetermined speed.

9. The document removal apparatus of claim 1, wherein said mode of operation of said document advancing means to decrease the pressure applied by said stack of documents against said feeder means includes means to halt the advancement of said documents towards said feeder means responsive to said signal.

10. The document removal apparatus of claim 1, wherein said mode of operation of said document advancing means to decrease the pressure applied by said stack of documents against said feeder means includes means to reverse the direction of movement of said documents and move said stack of documents away from said feeder means responsive to said signal.

11. The document removal apparatus of claim 1, wherein said mode of operation of said document advancing means to increase the pressure applied by said stack of documents against said feeder means includes means to advance the stack of documents towards said feeder means responsive to said signal.

12. A method for sequentially removing a leading document from a stack of documents using at least one moving document feed element comprising the steps of:

identifying a predetermined torque to be applied to the leading document by the feed element at which only the leading document is removed from the stack;

advancing the stack of documents toward the feed element such that the leading document contacts the feed element;

sensing the torque applied by the moving document feed element to the leading document by measuring the speed of movement of the document feed element;

decreasing the pressure of the stack of documents against the feed element when the torque is above the predetermined torque;

increasing the pressure of the stack of documents against the feed element when the torque is below the predetermined torque;

whereby the torque applied by the moveable document feed element to the leading document is maintained substantially at the level of said predetermined torque, and only each sequential leading document is removed from the stack of documents by the moveable document feed element.

13. Apparatus for removing the leading document from a stack of documents, said apparatus having at least one feed element moving at a predetermined, load sensitive speed comprising:

means for identifying a predetermined limited torque to be applied to the leading document by the moving feed element at which torque only the leading document is removed from the stack;

means for advancing the stack and the leading document against the moving feed element to apply torque against the leading document, said torque applied by the moving feed element removing the leading document from the stack;

means for sensing the torque applied by the feed element to the leading document;

means responsive to sensing said torque for controlling the torque applied by the feed element to the leading document by increasing the torque if the torque is below the predetermined torque, and decreasing the torque if the torque is above the predetermined torque;

whereby the torque applied by the feed element to the leading document in the stack is maintained at a substantially constant value, and only the leading document is removed from the stack by the moveable feed element.

14. The apparatus of claim 13 wherein said advancing means comprises movable conveyor belt means disposed adjacent the stack of documents which selectively move the stack towards and away from the moveable feed element.

15. The apparatus of claim 13 wherein the speed of the moveable feed element changes in response to variations in the pressure placed against the moveable feed element by the stack of documents.

16. The apparatus of claim 15 wherein said torque sensing means comprises means for generating an electrical signal which is related to the speed of movement of the moveable feed element.

17. The apparatus of claim 16 wherein said generating means comprises an electrical generator which produces a voltage output proportional to the speed of movement of the moveable feed element.

18. The apparatus of claim 17 wherein said generator comprises a wheel which is rotated by the moveable feed element to operate said generator.

19. The apparatus of claim 16 wherein said predetermined torque identifying means comprises means for generating a reference signal which is related to said electrical signal of said torque sensing means when the moveable feed element is at the predetermined speed.

20. The apparatus of claim 19 wherein said torque controlling means comprises means for determining the difference between said electrical signal and said reference signal.

21. The apparatus of claim 20 wherein said document advancing means comprises at least one conveyor belt disposed adjacent the stack of documents which moves the stack towards and away from the moveable feed element, said conveyor belt increasing the torque applied to the leading document by moving the stack towards the moveable feed element, and decreasing the torque applied to the leading document by moving the stack away from the moveable feed element;

said torque controlling means including means for moving the stack towards or away from the moveable feed element depending on the polarity of the difference between said electrical signal and said reference signal.

22. The apparatus of claim 21 wherein movement of said conveyor belt is operated by a reversible motor, said difference determining means comprising a differential amplifier, the electrical signal providing one input to said differential amplifier, the reference signal providing a second input to said differential amplifier, and said differential amplifier providing an output related to the difference between the electrical signal and the reference signal;

said torque controlling means comprising two transistors of opposite polarity, the first of said transistors being capable of providing electrical current to operate said reversible motor in one direction and the second of said transistors being capable of providing electrical current to operate said reversible motor in the opposite direction, both of said transistors being controlled by the output of said differential amplifier, so that said first transistor is turned on if said differential amplifier output has one polarity, and said second transistor is turned on if said differential amplifier output has the opposite polarity.

* * * * *